US009303431B2

(12) United States Patent
Schmidt-Lackner et al.

(10) Patent No.: US 9,303,431 B2
(45) **Date of Patent: *Apr. 5, 2016**

(54) DOOR ENTRY SYSTEM

(71) Applicant: Consumer 2.0, Inc., Los Angeles, CA (US)

(72) Inventors: Merrick Schmidt-Lackner, Los Angeles, CA (US); Clark Li, Thousand Oaks, CA (US)

(73) Assignee: Consumer 2.0, Inc., Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/823,975

(22) Filed: Aug. 11, 2015

(65) Prior Publication Data

US 2015/0345176 A1 Dec. 3, 2015

Related U.S. Application Data

(63) Continuation of application No. 14/495,651, filed on Sep. 24, 2014, now Pat. No. 9,127,478, which is a continuation of application No. 14/038,542, filed on Sep. 26, 2013, now Pat. No. 8,869,574.

(60) Provisional application No. 61/789,117, filed on Mar. 15, 2013.

(51) Int. Cl.

| | |
|---|---|
| ***E05B 17/14*** | (2006.01) |
| ***E05B 47/06*** | (2006.01) |
| ***E05B 13/00*** | (2006.01) |
| *E05B 47/00* | (2006.01) |

(52) U.S. Cl.

CPC ..... *E05B 17/147* (2013.01); *E05B 13/001* (2013.01); *E05B 47/068* (2013.01); *E05B 47/0012* (2013.01); *Y10T 70/5319* (2015.04); *Y10T 70/5978* (2015.04); *Y10T 70/60* (2015.04); *Y10T 70/7062* (2015.04); *Y10T 70/7068* (2015.04); *Y10T 70/7876* (2015.04); *Y10T 70/8676* (2015.04); *Y10T 292/1097* (2015.04)

(58) Field of Classification Search

CPC ... E05B 65/025; E05B 17/042; E05B 17/147; E05B 17/145; E05B 17/0058

USPC ..... 70/124, 129, 256, 257, 277, 70/278.1–278.3, 280, 416, 456 R, 408; 292/144

See application file for complete search history.

(56) References Cited

U.S. PATENT DOCUMENTS

| | | | | |
|---|---|---|---|---|
| 5,184,491 | A * | 2/1993 | Schittenhelm | E05B 37/08 70/278.1 |
| 6,591,643 | B1 * | 7/2003 | Cannella | E05B 47/0012 292/142 |
| 7,231,791 | B2 * | 6/2007 | Sakai | E05B 47/0012 70/277 |
| 8,869,574 | B2 * | 10/2014 | Schmidt-Lackner | E05B 17/147 292/244 |
| 9,127,478 | B2 * | 9/2015 | Schmidt-Lackner | E05B 47/068 |

* cited by examiner

*Primary Examiner* — Suzanne Barrett
(74) *Attorney, Agent, or Firm* — Douglas L. Weller

(57) ABSTRACT

A door entry device comprising includes a case, a key holder and a key pad. The case covers a door-locking device on a door. The key holder has a slot into which a key end fits. The knob is mounted on the case. A currently active security code can be entered into the keypad. When the currently active security code has been entered into the keypad, turning the knob results in turning the key holder to unlock the door-locking device.

6 Claims, 10 Drawing Sheets

DOOR ENTRY SYSTEM

BACKGROUND

A real-estate lock box is shaped to be secured to a doorknob or other structure attached to a property. The lock box contains a key to a home, apartment, office or other locked portion of real estate property. To obtain the key, a user of the lock box uses another manual key, a security code or a swipe card to open the lock box and obtain the key to the property. The property can then be accessed using the key to the property. After accessing the property, the key is returned to the lock box to be available for the next user.

DETAILED DESCRIPTION

Figure 1:
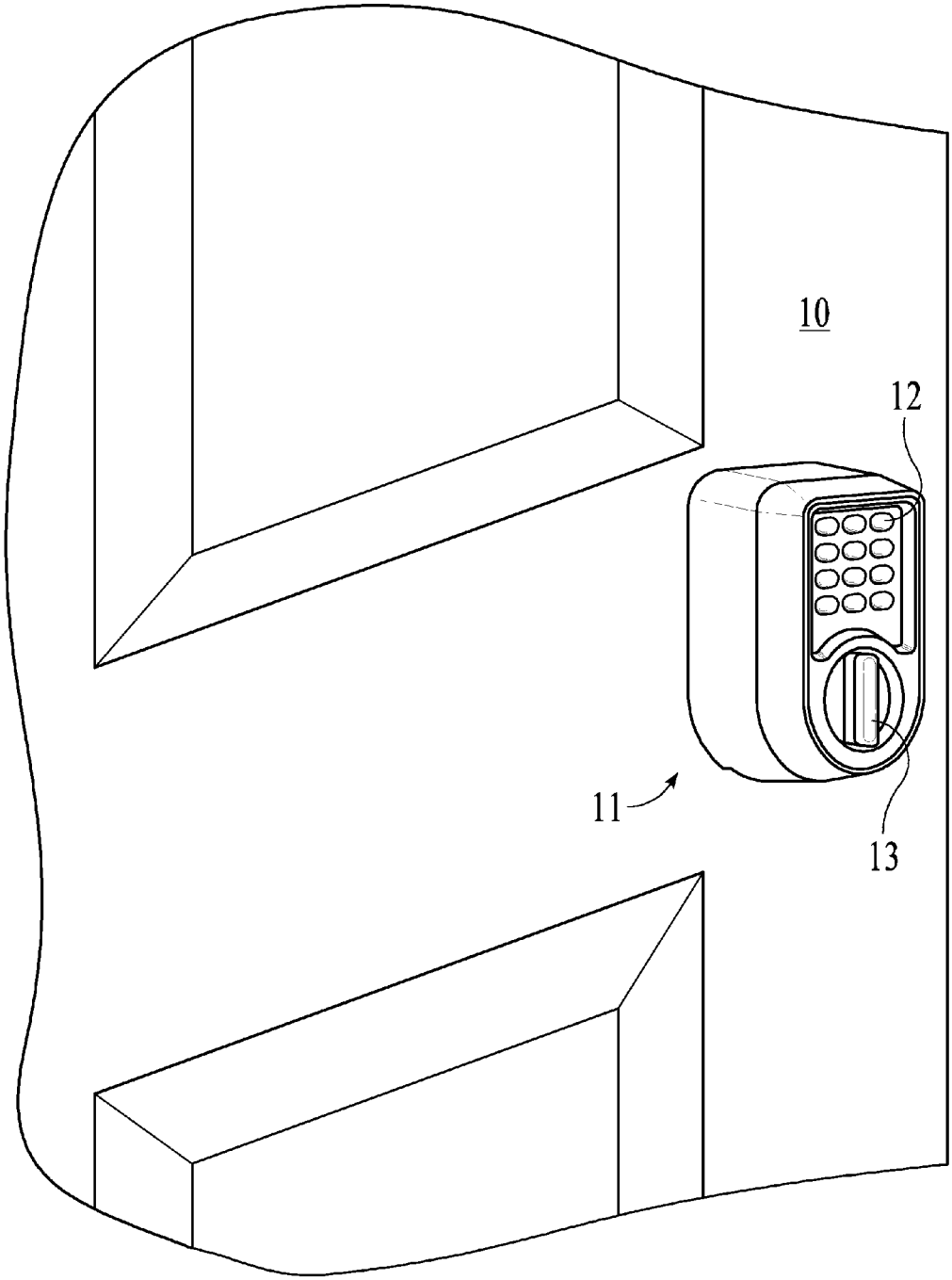
FIG. 1 shows a door entry device attached to a door in accordance with an embodiment.

FIG. 1 shows a door entry device 11 that allows property owners and managers to conveniently provide secure and keyless entry into properties. Door entry device 11 is designed to be easily installed over the outside of a door-locking device such as a deadbolt or a doorknob on a door 10. Keyless access is provided, for example, using a keypad 12. Once a currently active security code is punched into keypad 12, a user can turn knob 13 to unlock the deadbolt or door knob and open door 10.

In the following description and Figures, embodiments of door entry device 11 are illustrated as interacting with a dead bolt. However, as will be understood by persons of ordinary skill in the art, door entry device 11 could also be a door knob or other door entry device that utilizes a key.

Figure 2:
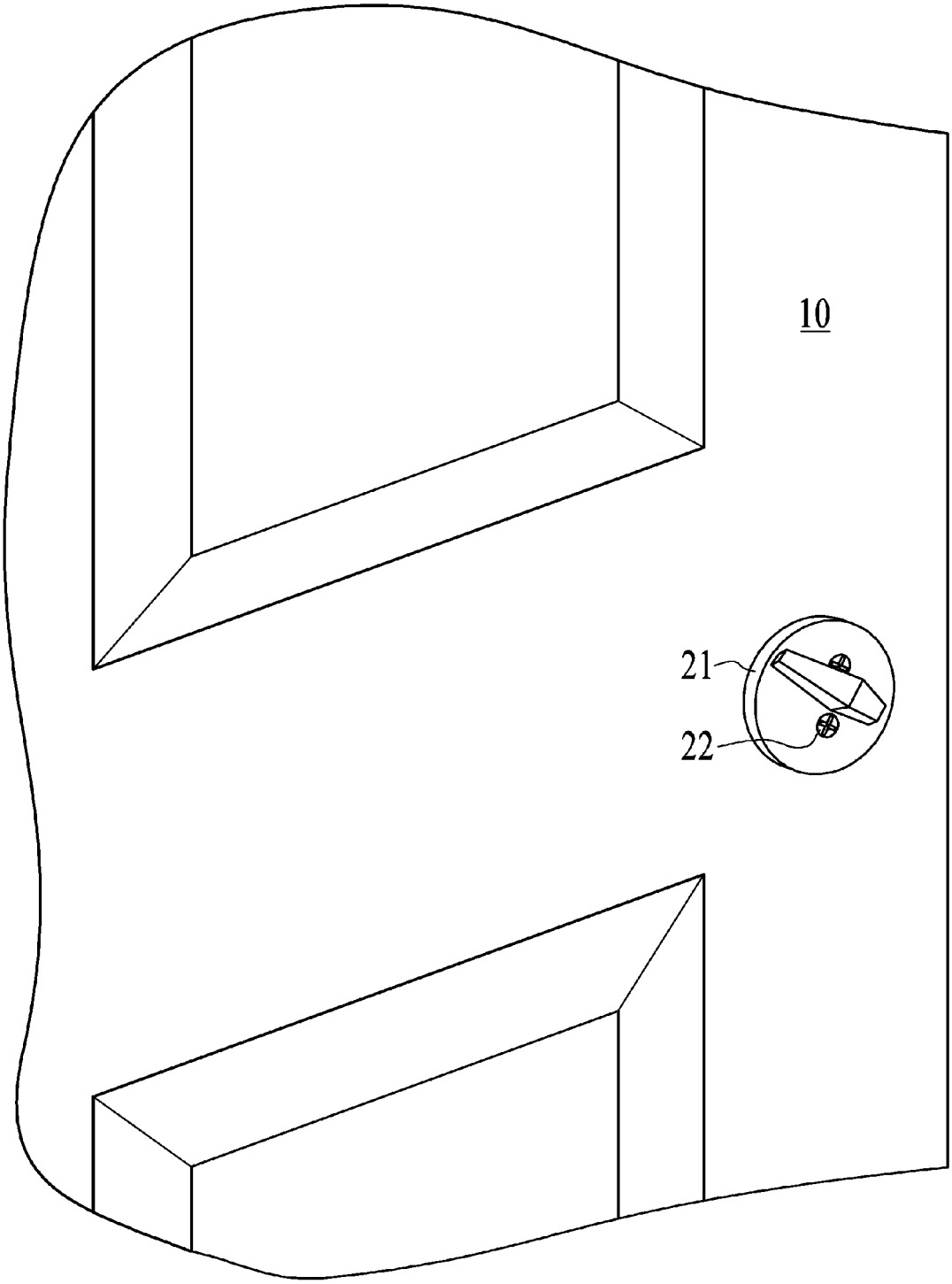
FIG. 2 illustrates loosening a dead bolt from inside a door in preparation to mount a door entry device in accordance with an embodiment.
Figure 3:
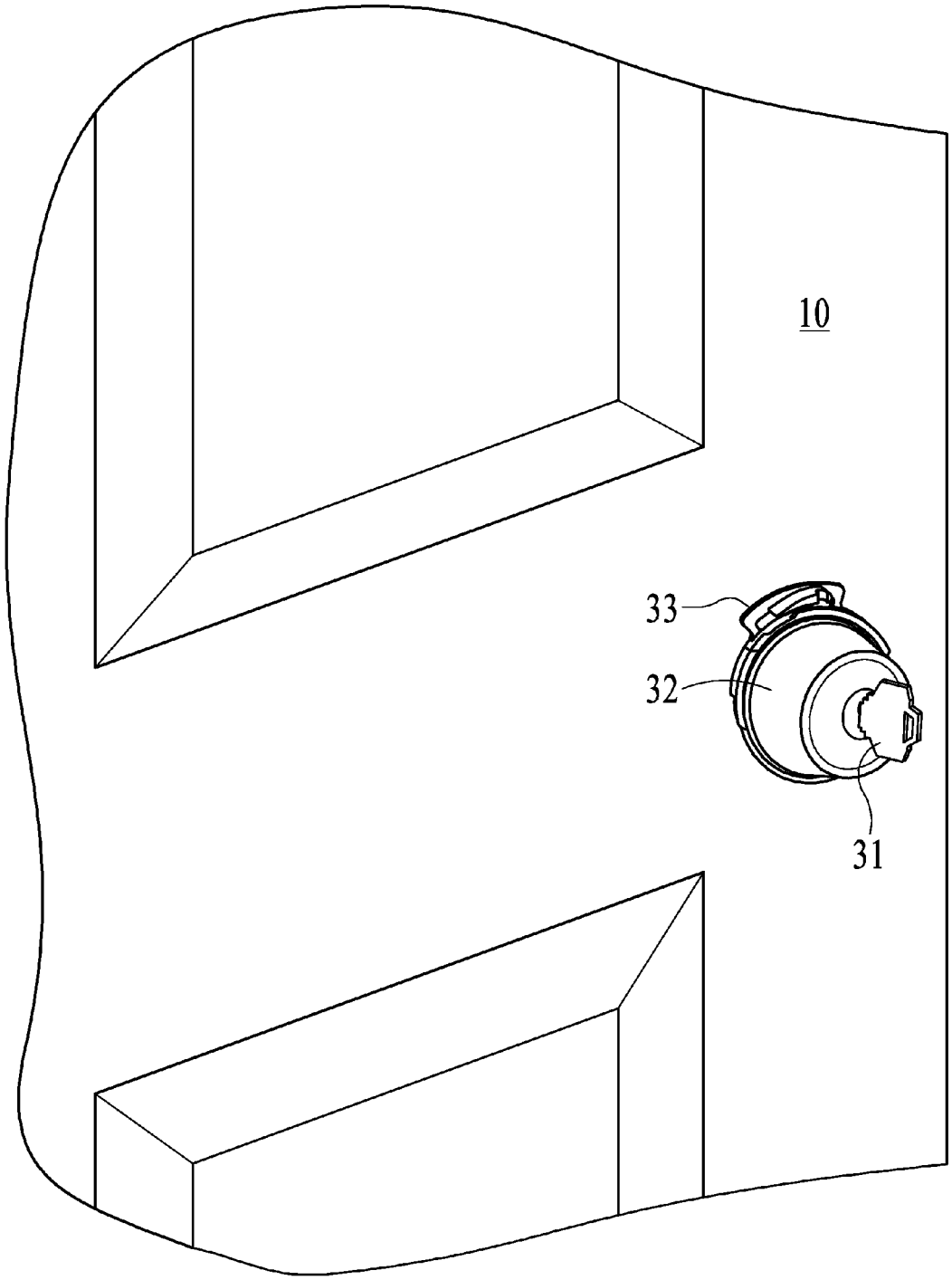
FIG. 3 illustrates a lock ring secured under a dead bolt on the outside of a door in preparation to mount a door entry device in accordance with an embodiment.

As illustrated by FIG. 2, door entry device 11 is easily installed by loosening screws 22 behind an inside dead bolt part 21 located on an inside of door 10. This allows enough space so that, as illustrated by FIG. 3, a lock ring 33 can be placed between a door and an outside deadbolt part 31. A key 32 is placed in a key hole within outside deadbolt part 31. For example, key 32 can be rotated clockwise to lock the deadbolt and turned counter-clockwise to unlock the deadbolt.

Figure 4:
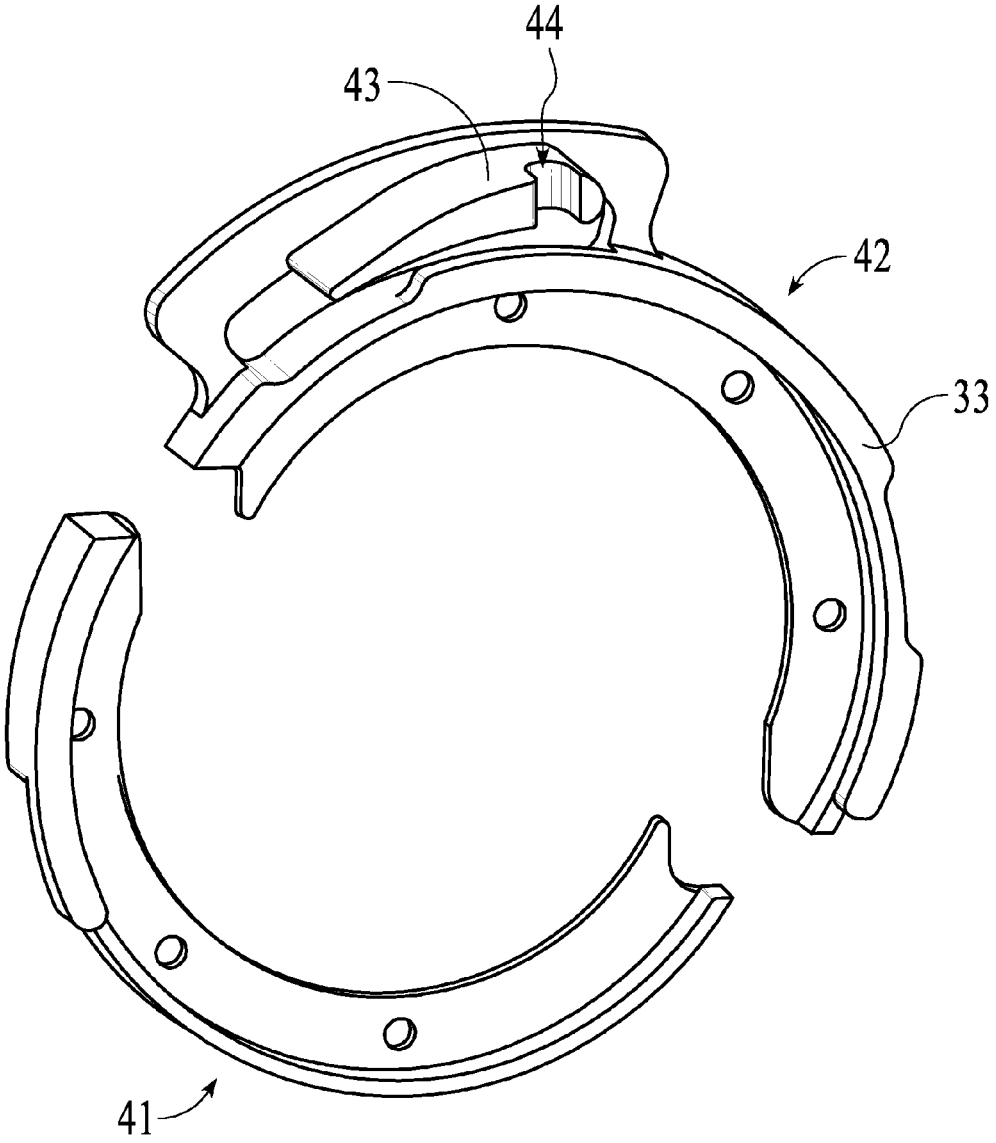
FIG. 4 shows additional detail of the lock ring shown in FIG. 3 in accordance with an embodiment.

FIG. 4 shows additional detail of the lock ring 33. For example, lock ring 33 has two pieces allowing lock ring 33 to be put in place behind outside deadbolt part 31 by only loosening screws 22 and not completely removing lock ring 33 from door. Lock ring 33 can then be anchored to door 10 by outside deadbolt part 31 by tightening screws 22.

Specifically, lock ring 33 includes a portion 41 and a portion 42. The two portions of lock ring 33 allow for lock ring 33 to be placed between door 10 and outside deadbolt part 31 without completely removing deadbolt part 31 from door 10. A locking mechanism 43 with a groove 44 is used to lock door entry device 11 to lock ring 33 so that door entry device 11 is secured in place over deadbolt part 31.

Figure 5:
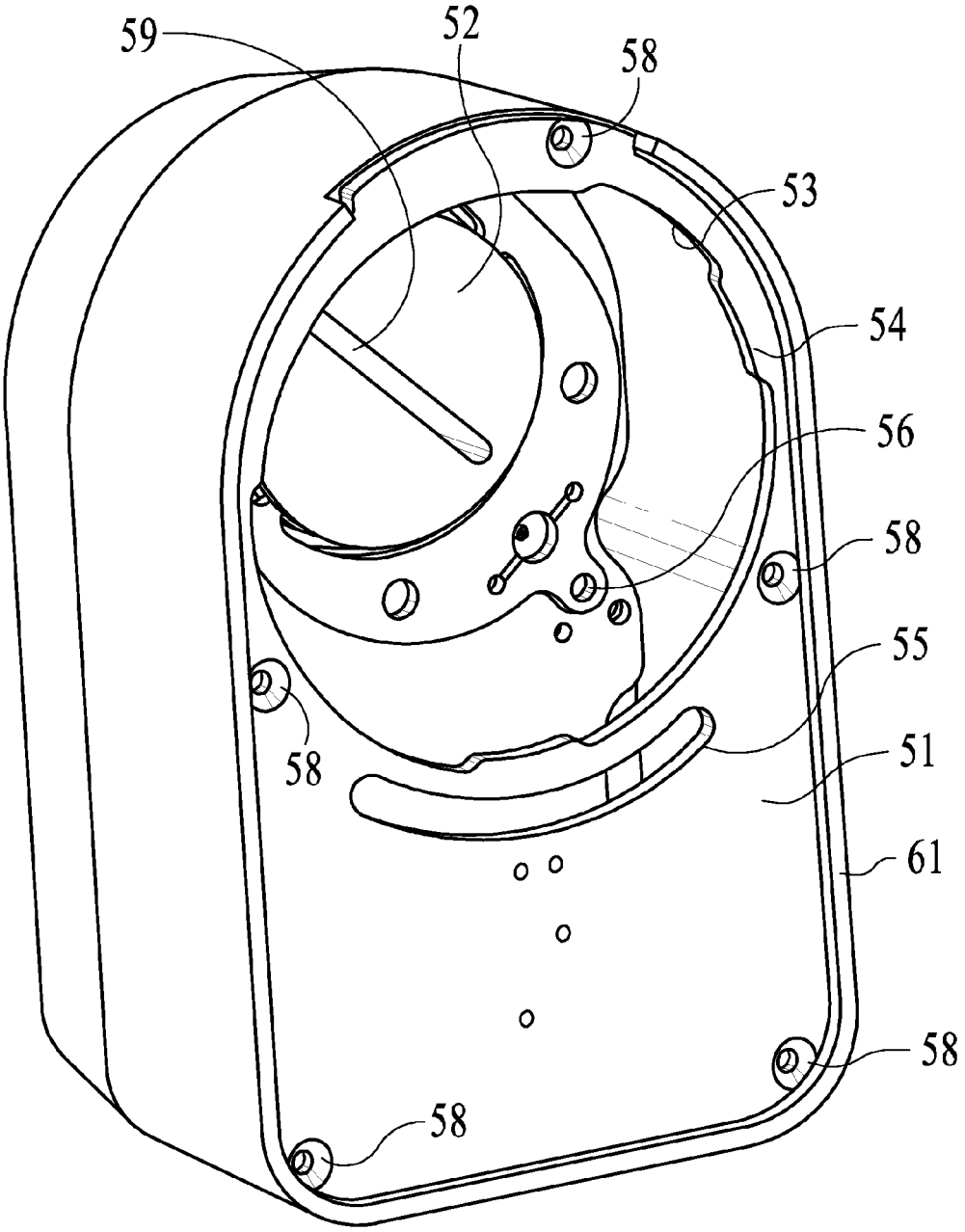
FIG. 5 is a view looking into a back side of the door entry device shown in FIG. 1 in accordance with an embodiment.

FIG. 5 shows a view into a back side of door entry device 11. Within a case 61, a plate 51 is attached, for example, using screws in screw holes 58. A toothed edge 53 interlocks with lock ring 33 and when engaged holds door entry device 11 tight against lock ring 33 and over outside dead bolt portion 31. Locking mechanism 43 fits within a slot 55 of plate 51. A key holder 52 includes a slot 59 that receives key 32 allowing key 32 to be turned by turning key holder 52. Key holder 52 is mounted on a plate 56.

Figure 6:
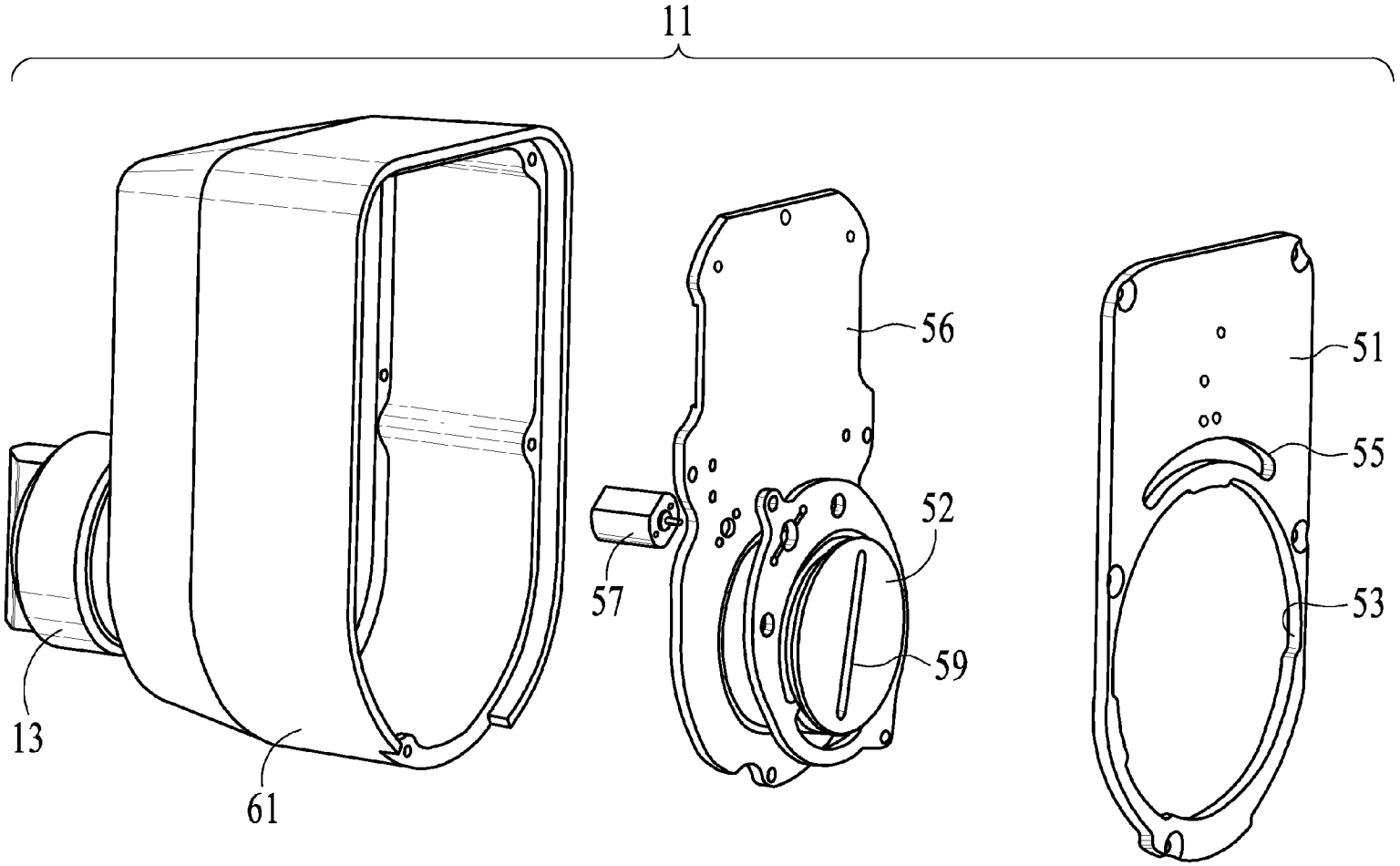
FIG. 6 is an exploded view of the door entry device shown in FIG. 1 in accordance with an embodiment.

FIG. 6 is an exploded view of door entry device 11. A knob 13 is used to turn key holder 52. A clutch motor 57 is used to engage or disengage a clutch within key holder 52. For example, clutch motor is an Amico DC 4.5V 0.75A Pull Type Open Frame 4 mm 29Gf Solenoid Electromagnet, or other suitable device that can act as a clutch motor.

When clutch motor 57 is active, the clutch within key holder 52 is engaged so that knob 13 turns key holder 52. When clutch motor 57 is not active, the clutch within key holder 52 is disengaged so that knob 13 spins freely in the counter clockwise direction without turning key holder 52.

Figure 7:
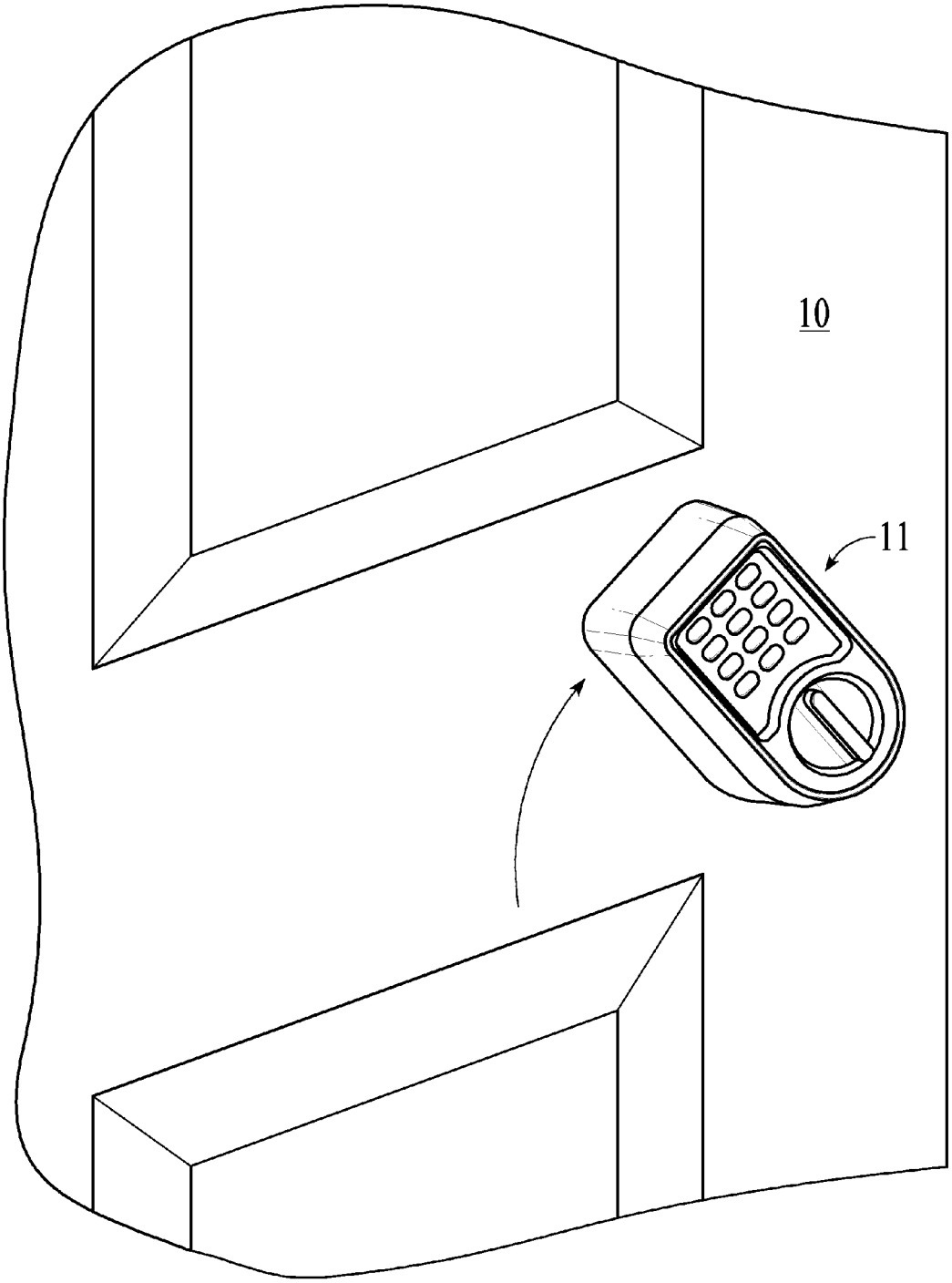
FIG. 7 illustrates detail of a door entry device being mounted on a door in accordance with an embodiment.

FIG. 7 shows door entry device 11 placed over outside dead bolt portion 31 with tooth edge 53 being placed through and under matching teeth of lock ring 33. From this position, rotating door entry device 11 clockwise locks rotating door entry device 11 to lock ring 33. Locking mechanism 43 will engage preventing the rotation of door entry device 11 counterclockwise, effectively locking door entry device 11 in place over outside dead bolt portion 31 and preventing access to dead bolt portion 31. For example, door entry device 11 is held locked in place by a spring-loaded bolt that falls into slot 44 when door entry device 11 is rotated into the locked position.

For example, it is possible to remove door entry device 11 from covering outside dead bolt portion 31 by entering into keyboard 12 first the currently active security code and then the code for release door entry device 11. For example, when the code to release door entry device 11 is entered a small bolt motor within door entry device 11 removes the spring loaded bolt from slot 44 allowing counter-clockwise rotation of door entry device 11 into a release position. For example, the small bolt motor is an Amico DC 4.5V 0.75A Pull Type Open Frame 4 mm 29Gf Solenoid Electromagnet, or other suitable device that can act as a small bolt motor.

Alternatively, a user can loosen screws 22 behind inside dead bolt part 21 located on an inside of door 10 (shown in FIG. 2). Then portion 41 and portion 42 and be removed from door 10, allowing removal of door entry device 11 from covering outside dead bolt portion 31.

Figure 8:
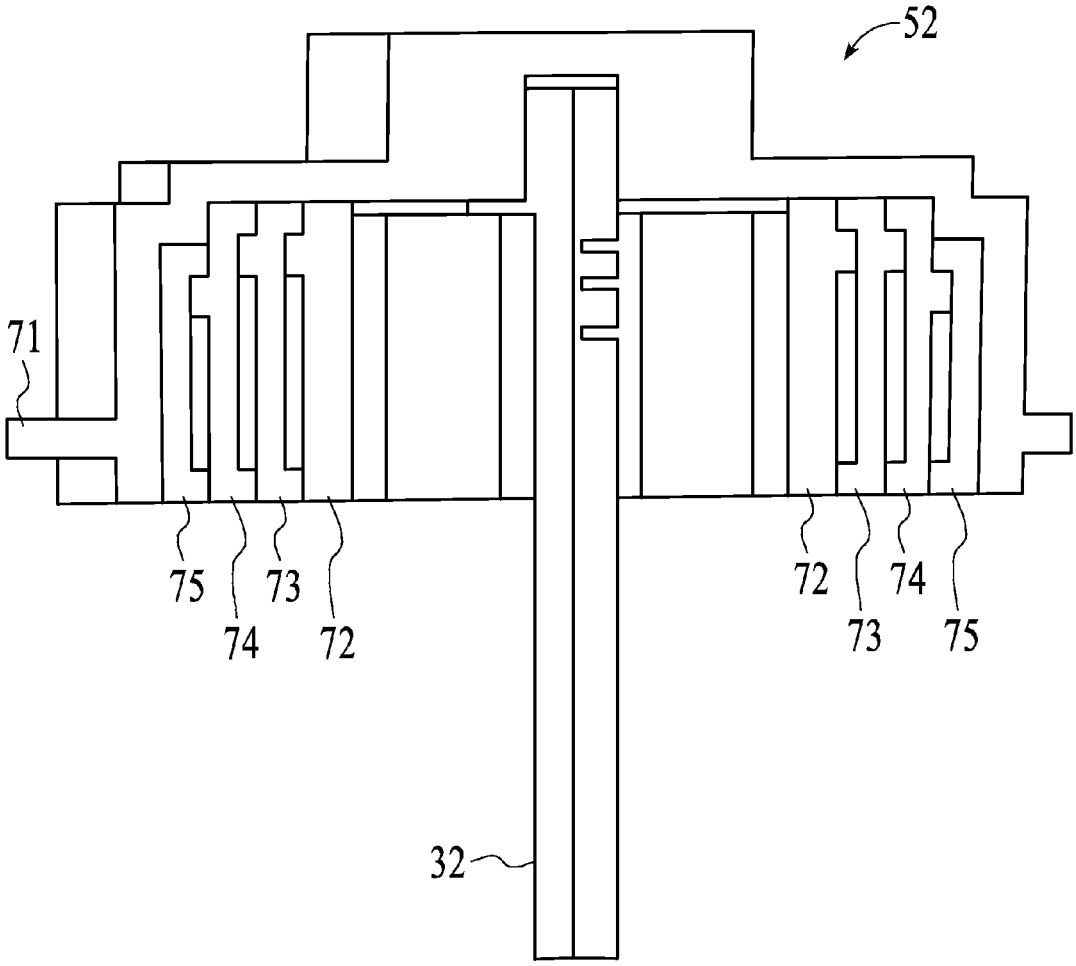
FIG. 8, FIG. 9 and FIG. 10 illustrate an internal component of the door entry device shown in FIG. 1 being adjustable to accommodate a height of a dead bolt or other door-locking device in accordance with an embodiment.

In order to accommodate deadbolts or other door locking devices of different heights, key holder 52 can be adjusted. For example, when the deadbolt has a shallow height or is flush to door 10, key holder 52 is in a fully closed position so that slot 59 is located in a position to receive key 32 when door entry device 11 is locked in place over outside dead bolt portion 31. In this case, for example, a telescoping portion 72, a telescoping portion 73, a telescoping portion 74 and a telescoping portion 75 are in a closed position, as shown in FIG. 8.

Figure 9:
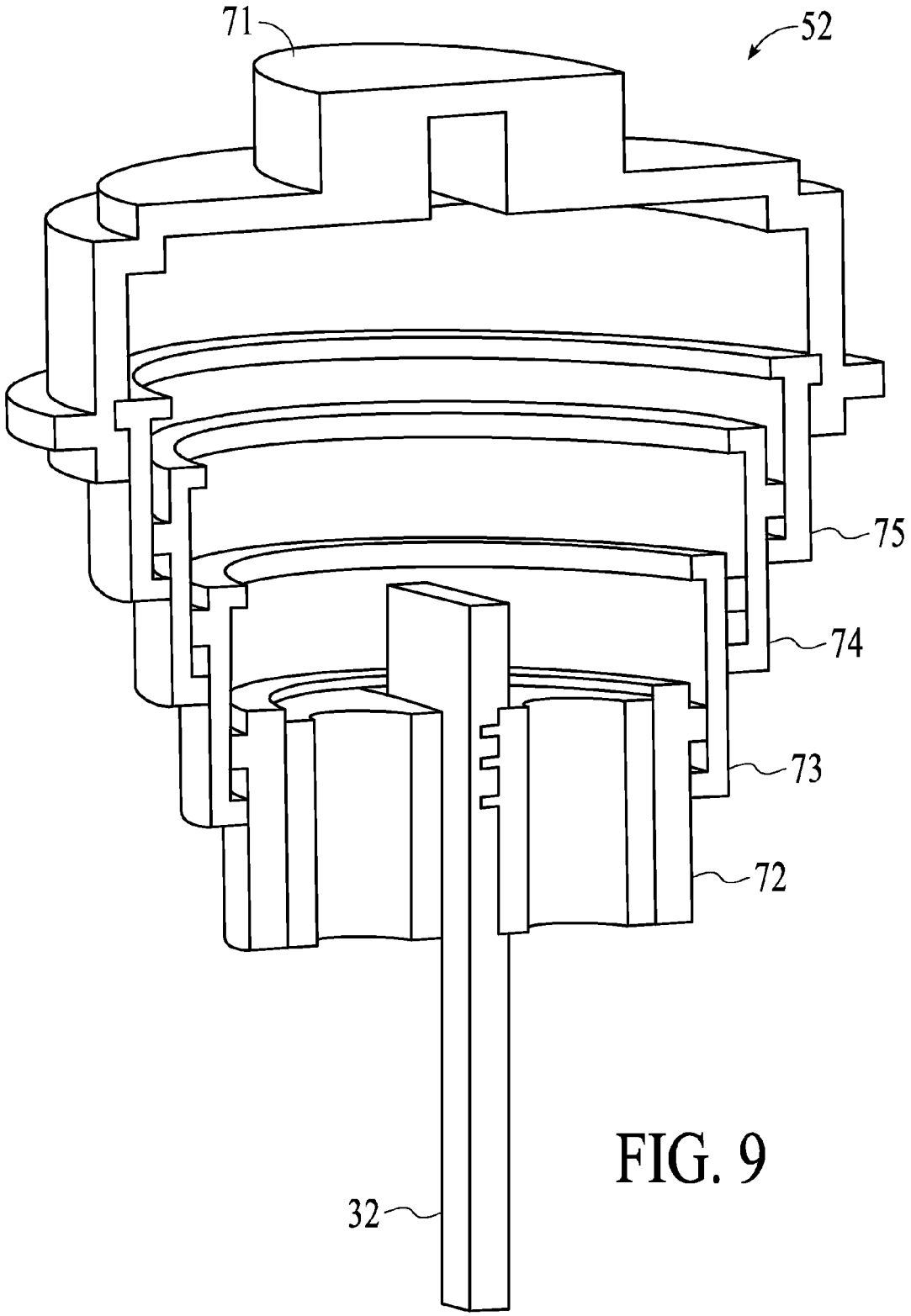

For example, when the deadbolt or other door locking device has a large height, key holder 52 is in a fully open position so that slot 59 is located in a position to receive key 32 when door entry device 11 is locked in place over outside dead bolt portion 31. In this case, for example, telescoping portion 72, telescoping portion 73, telescoping portion 74 and telescoping portion 75 are in a fully open position, as shown in FIG. 9.

Figure 10:
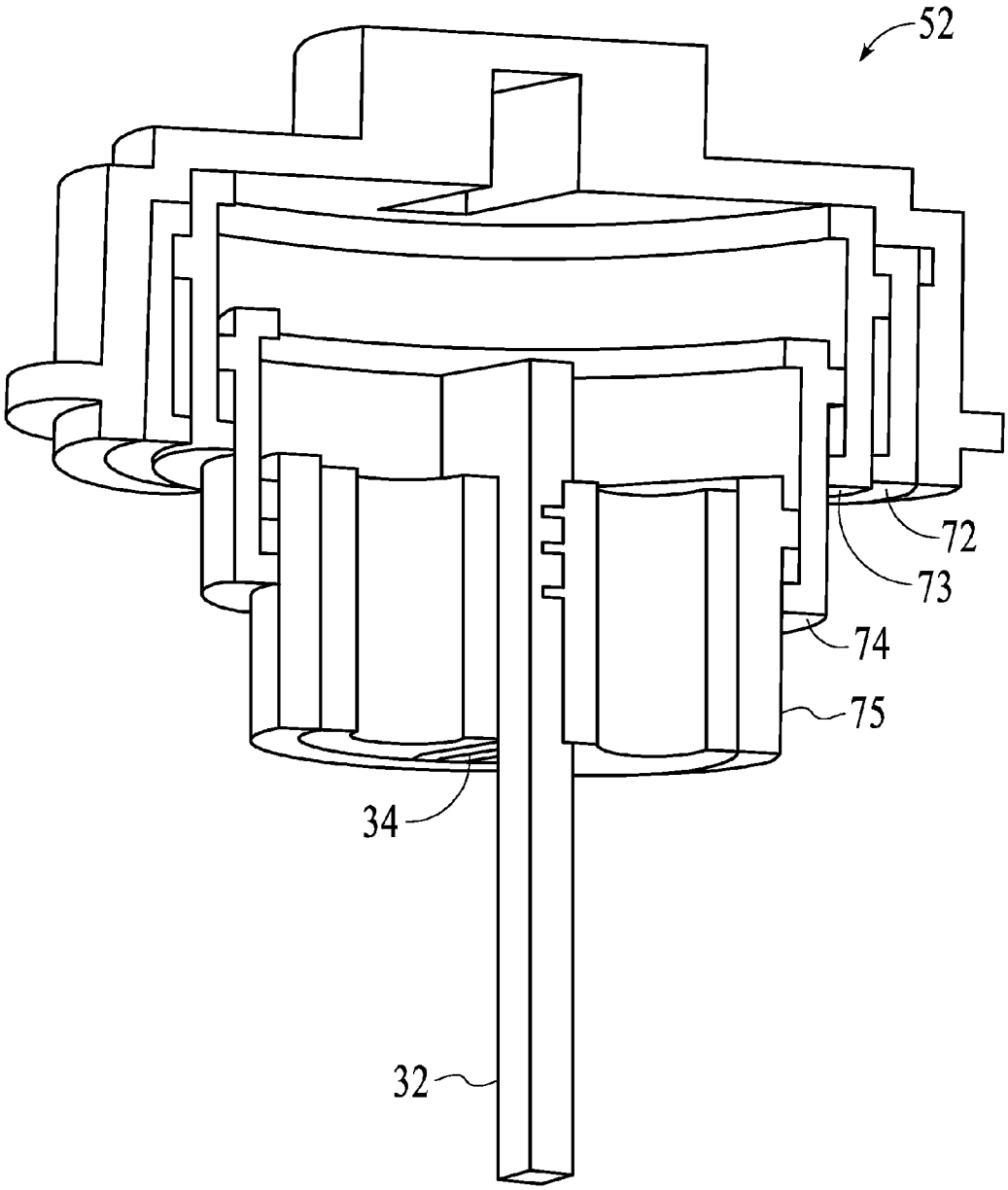

For example, when the deadbolt or other door locking device has a medium height, key holder 52 is in a partially open position so that slot 59 is located in a position to receive key 32 when door entry device 11 is locked in place over outside dead bolt portion 31. In this case, for example, telescoping portion 72 and telescoping portion 73 are in an open position while telescoping portion 74 and telescoping portion 75 are in a closed position, as shown in FIG. 10.

Once door entry device 11 is locked in place, a user desiring to enter a property can do so by entering a currently active security code on keyboard 12. For example, an appropriate security code may be 4 to 8 digits or some other number of digits or other selections on keyboard 12. Once the currently active security code is entered, clutch motor 57 is activated. As a result, the clutch within key holder 52 is engaged so that knob 13 turns key holder 52. The user can then turn key holder 52 in a counter clockwise direction, thereby also turning key 32 in the key hole within outside deadbolt part 31. This unlocks door 10 allowing the user to enter the property.

A short while after being activated, clutch motor 57 is deactivated so that the clutch within key holder 52 is disengaged so that knob 13 spins freely in the counterclockwise direction without turning key holder 52. In one embodiment, when the clutch within key holder 52 is disengaged, knob 13 also spins freely in the clockwise direction without turning key holder 52 so that it is necessary to re-enter the currently active security code on keyboard 12 in order to use key 32 to lock door 10 from the outside. In another embodiment, when the clutch within key holder 52 is disengaged, knob 13 turning in the clockwise direction turns key holder 52 enough so that it is possible to use key 32 to lock door 10 from the outside without re-entering the currently active security code on keyboard 12.

In one embodiment, the currently active security code for door entry device 11 changes periodically. For example, the currently active security code can be changed once a day. Alternatively, the frequency of change can be selected as appropriate to particular circumstances. For example, the currently active security code can change more frequency, for example, once per hour or even more often, when only a short amount of access for each user is desirable. This may be convenient, for example, for a property manager allowing a prospective renter a brief access to inspect a potential rental. Alternatively, the currently active security code can change less frequency, for example once per week when a vacation rental is rented to a user for a week, in order for a renter to need know only one single security code to enter a rental property for the entire term of the rental.

A pattern by which a currently active security code is selected may be pseudo random, for example, selected by a hashing algorithm or some other algorithm or stored data. For example, door entry device 11 is synchronized with a server so that an internal clock within door entry device 11 is synchronized with time kept by the server and wherein the hashing algorithm, other algorithm or stored data is synchronized and initialized to be used both by door entry device and the server. In this way, the server can always correctly predict the currently active security code for door entry device 11 without the need of any wireless or wired connection between door entry device 11 and the server. A user, if granted permission, can access the currently active security code for door entry device 11 from the server. Then, all a user needs to unlock and access a property is the currently active security code obtained from the server.

For example, within keypad 12 resides a processor such as an Atmega328P available from Atmel Corporation. The processor is able to receive and recognize the currently active security code. In addition, once the currently active security code has been recognized, other instructions may be given to the processor through keypad 12. The instructions can be, for example, a command to reset a security code generating algorithm, a command specifying a frequency with which the security code is changed, a command making a particular security code permanent, a command revoking a previous command to make the particular security code permanent, a command to remove the spring loaded bolt from slot 44 allowing counter-clockwise rotation of door entry device 11 into a release position, or some other command.

The foregoing discussion discloses and describes merely exemplary methods and embodiments. As will be understood by those familiar with the art, the disclosed subject matter may be embodied in other specific forms without departing from the spirit or characteristics thereof. Accordingly, the present disclosure is intended to be illustrative, but not limiting, of the scope of the invention, which will be set forth in claims.

What is claimed is:

1. A door entry device that controls entrance to an inside area protected by a door, comprising:

a case that covers an outside portion of a door-locking device on the door;

a key holder with a slot into which a key end fits;

a knob mounted on the case;

a keypad mounted on the case, wherein a currently active security code can be entered into the keypad, the security code requiring a plurality of selections on the keypad; and, wherein when the security code is entered, the key holder is actively engaged with the knob so that a user can unlock the door by turning the knob, and wherein when the key holder and the knob are disengaged, a user cannot unlock the door by turning the knob but can lock the door by turning the knob.

2. A door entry system as in claim 1 wherein the currently active security code changes periodically.

3. A door entry system as in claim 1 wherein the door-locking device is a deadbolt having a keyhole.

4. A door entry device comprising:

a case that covers a door-locking device on a door so that the door-locking device cannot be directly accessed from an outside area;

a key holder with a slot into which a key end fits;

a knob mounted on the case;

a keypad mounted on the case, wherein a currently active security code can be entered into the keypad, the security code requiring a plurality of selections on the keypad; and, wherein when the security code is entered, the key holder is actively engaged with the knob so that a user can unlock the door by turning the knob, and wherein when the key holder and the knob are disengaged, a user cannot unlock the door by turning the knob but can lock the door by turning the knob.

5. A door entry system as in claim 4 wherein the currently active security code changes periodically.

6. A door entry system as in claim 4 wherein the door-locking device is a deadbolt having a keyhole.

* * * * *